United States Patent [19]

Theobald et al.

[11] Patent Number: 4,832,648

[45] Date of Patent: May 23, 1989

[54] STUFFED FIGURE TOY USEABLE AS A BOOK COVER

[75] Inventors: J. Robert Theobald, Sagamore Hills; Judity Thayer, Cleveland, both of Ohio

[73] Assignee: Those Characters From Cleveland, Inc., Cleveland, Ohio

[21] Appl. No.: 130,410

[22] Filed: Dec. 9, 1987

[51] Int. Cl.[4] ..... A63H 3/02; A63H 33/38; B42D 3/00

[52] U.S. Cl. ..... 446/72; 446/148; 446/370; 446/380; 281/29; 281/34

[58] Field of Search ..... 446/71, 72, 73, 369, 446/370, 371, 373, 375, 380, 147, 148, 327; 281/29, 34; 283/64; D19/26, 28, 29, 30

[56] References Cited

U.S. PATENT DOCUMENTS

| | | | |
|---|---|---|---|
| D. 38,643 | 6/1907 | Garman | 283/64 X |
| D. 143,943 | 2/1946 | Baumann | D19/29 |
| 1,528,087 | 3/1925 | Sheridan et al. | 281/29 |
| 1,560,877 | 11/1925 | Taggart | 446/370 |
| 1,887,338 | 11/1932 | Stephens | 281/29 |
| 1,992,618 | 2/1935 | Jeffreys | 446/148 |
| 2,224,703 | 12/1940 | Spencer | 281/34 X |
| 2,669,064 | 2/1954 | Stewart | 446/330 |
| 3,273,283 | 9/1966 | Wolf | 446/330 |
| 3,855,726 | 12/1974 | Yumoto | 446/148 |
| 3,928,933 | 12/1975 | Iwamoto | 446/330 |
| 4,508,515 | 4/1985 | Skolnick | 446/148 |
| 4,608,024 | 8/1986 | Skolnick | 446/148 |

FOREIGN PATENT DOCUMENTS

| | | | |
|---|---|---|---|
| 28217 | of 1914 | United Kingdom | 283/64 |

*Primary Examiner*—Mickey Yu
*Assistant Examiner*—Charles H. Harris
*Attorney, Agent, or Firm*—Calfee, Halter & Griswold

[57] ABSTRACT

An aminated toy figurine which may be used as a cover for a book having a head and a body including a trunk and at least a pair of protruding appendages such as a pair of arms. Extending between the head and the trunk is a pivot member. One end of the pivot member is attached to the stuffing material inside the head. The other end of the pivot member is attached to the inside of the fabric forming the trunk. Extending and attached along the inside of the arms is a length of elastic. The length and elasticity of the elastic is such that when the arms are pulled together about a vertical surface, the elastic is tensioned forcing the fabric of the trunk and the pivot member to fulcrum against the vertical surface raising the head of the figurine. Alternatively, when the arms are moved apart, the tension on the elastic is reduced allowing gravitational forces to act on the head permitting the pivot member to pivot away from the vertical surface and thus lower the head of the figurine.

18 Claims, 2 Drawing Sheets

STUFFED FIGURE TOY USEABLE AS A BOOK COVER

DISCLOSURE

The invention relates to the field of animated toys. More particularly, to an animated toy figurine which may serve as a cover for a book.

BACKGROUND

The prior art provides various animated toy figurines including toys which display animated motions or features in combination with a book. Unfortunately, such prior art devices require a book of special construction and/or configuration. For example, Jeffreys U.S. Pat. No. 1,992,618 discloses a book having folded cut-outs that pop up from the page as the book opens. To effectuate such animation the Jeffreys book utilizes a special construction comprising a plurality of interconnected and stacked blanks.

The present invention provides a distinct advantage over the prior art devices because it can be used in combination with a book of standard construction. Furthermore, an animated toy made in accordance with the present invention may be used in combination with any one of a variety of items having a vertically extending surface and is not exclusively limited to use with a book.

SUMMARY

The present invention provides an animated toy figurine having a head and a body including a trunk and at least a pair of protruding appendages. Extending between the head and the body is a rod-like pivot member. One end of the pivot member is attached to the stuffing inside the head and the other end of the pivot member is attached to the fabric which forms the trunk. Extending and attached along the nside of each of the arms is a length of elastic. The ends of each length of elastic extend respectively from the proximity of the pivot member to about the distal ends of the arms. The length and elasticity of the lengths of elastic are such that when the arms are pulled together about a vertically extending surface, the lengths of elastic are tensioned causing the fabric of the trunk and the pivot member to fulcrum and align against the vertically extending surface which in turn raises the head of the figurine. Alternatively, when the arms of the figurine are moved apart and the tension in the lengths of elastic is in turn reduced, gravitational forces being exerted on the head cause the fabric of the body and the pivot member to pivot away from the vertical surface resulting in the lowering of the head.

In a preferred embodiment the toy figurine is used in combination with a book and serves as a book jacket. The ends of the legs and arms include pockets which facilitate their attachment to the corners of the book. When the book is closed and the arms are brought together the lengths of elastic cause the fabric of the trunk and the pivot member to fulcrum and align against the spine of the book which in turn raises the head over the top of the book. Similarly, when the book is opened, the arms are moved apart and the tension on the lengths of elastic is released thereby allowing gravitational forces to cause the head to assume a lowered position wherein the pivot member extends substantially perpendicular to the spine of the book.

The foregoing and other features of the invention are hereinafter more fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION OF PREFERRED EMBODIMENT

Figure 1:
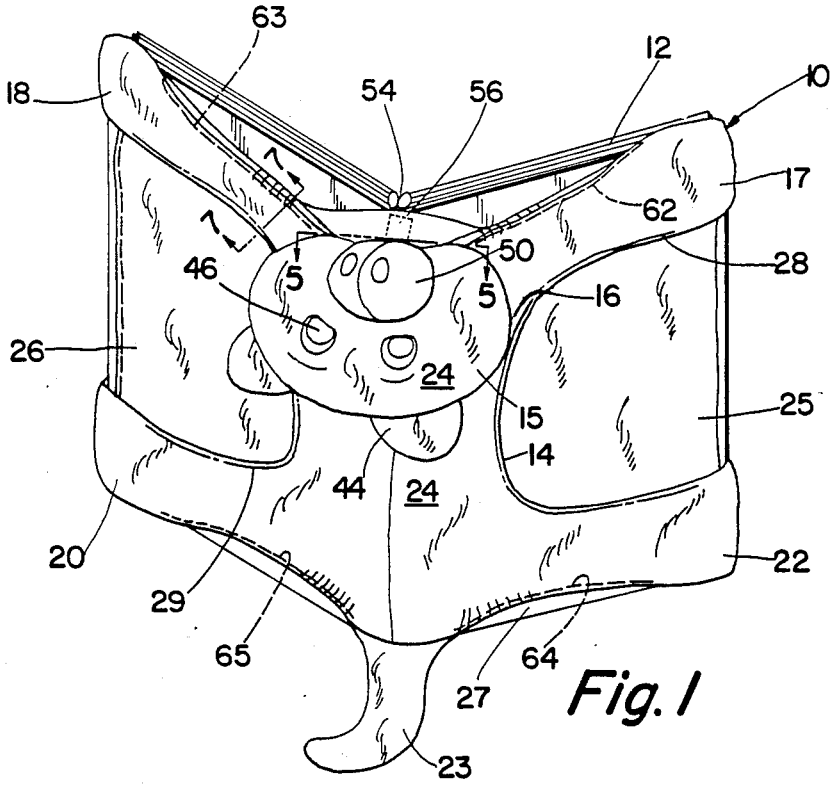
FIG. 1 is a perspective view of an animated toy figurine made in accordance with the present invention illustrated in combination with a book in the open position.
Figure 2:
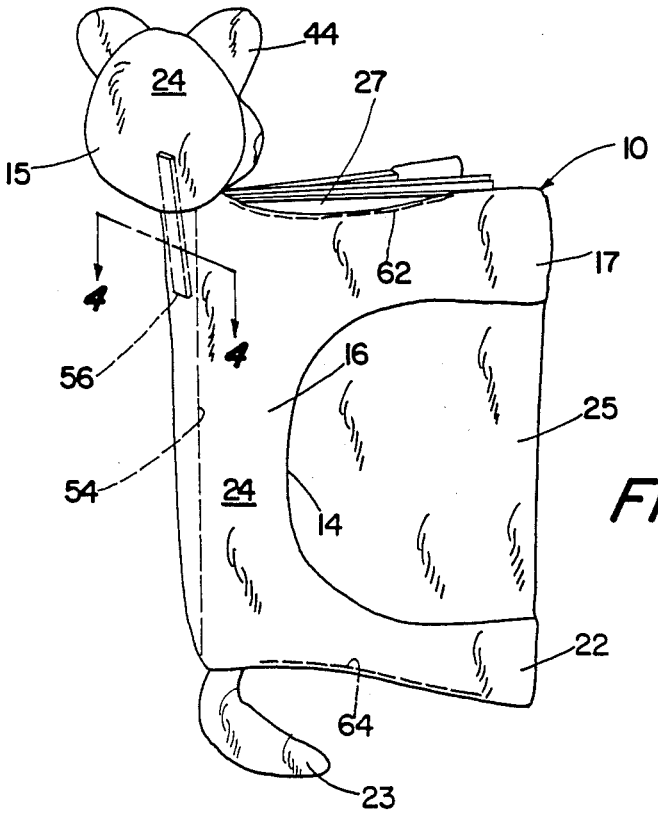
FIG. 2 is a perspective view of the toy figurine and book of FIG. 1 with the book in the closed position.

Referring to the drawings and initially to FIGS. 1 and 2, there is illustrated an animate fanciful toy figurine 10 made in accordance with the present invention. As shown, figurine 10 is being utilized in combination with a book 12. More particularly, figurine 10 is serving as a jacket for book 12.

FIG. 10 includes a body 14 and a head 15. The body 14 includes a trunk 16 and a plurality of apendages such as, for example, arms 17 and 18, legs 20 and 22, and a tail 23. Preferably, tail 23 is of sufficient length that it may be utilized as a book marker. The outer coverings of the head 15 and the body 14 are formed of a pliant or flaccid outer covering material 24 such as fabric comprising fibers of cotton, wool, polyester or other like commercial fiber. the fabric may include any one or combination of surface finishes including cut, plush or pile, so as to provide the figurine 10 with the desired aesthetic appearance. Body 14 may be produced by taking multiple pieces of fabric each cut to the shape of the body 14, and then stitching the pieces together along the perimeter thereof. However, it will be appreciated that the body 14 may be assembled in any one of a variety of ways and from any number of pieces of fabric including a single piece of fabric.

In order to produce a complete cover, there are provided interconnecting pieces of fabric 25 and 26 which extend between respective arms 17 and 18 and legs 20 and 22. It will be appreciated that in some applications pieces 25 and 26 may not desired. For example, pieces 25 and 26 may be eliminated if it is necessary to display the title on the cover 27 of the book 12. In applications where the pieces 25 and 26 are eliminated, preferably, lengths of elastic 28 and 29 as shown in phantom in FIG. 1 are provided so as to further assure the secure attachment of the figurine 10 to the book 12.

Figure 3:
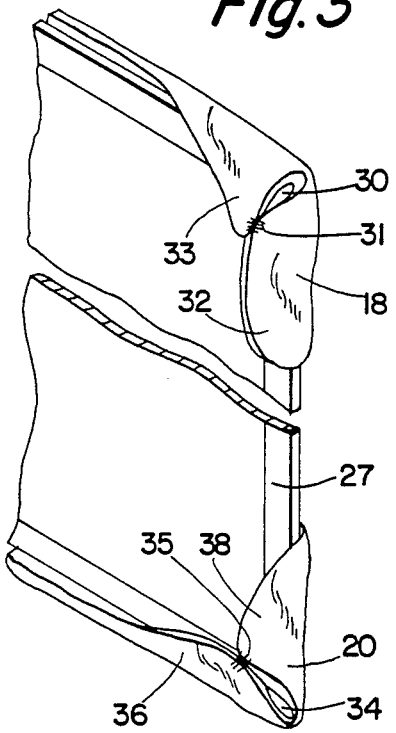
FIG. 3 is an enlarged fragmentary perspective view illustrating the pockets formed at the ends of the hands and legs of the figurine of FIG. 1 for engaging the corners of the cover of the book.

The distal ends of the arms 17 and 18 and the distal ends of the legs 20 and 22 are provided with pockets that facilitate the attachment of such appendages to the respective corners of the cover 27 of the book 12. More particularly, each of the arms 17 and 18 and legs 20 and 22 includes a pocket which is adapted to receive a corner of the cover 17. As illustrated in FIG. 3, the pocket 30 of the arm 18 is formed by folding and attaching at 31 the end corners 32 and 33 of the arm 18 together. Attachment of the end corners 32 and 33 may be accomplished by the use of the illustrated stitching, or for example by use of adhesive, or snaps. similarly, the pocket 34 of leg 20 is formed by folding and stitching at 35 the end corners 36 and 38 together.

Figure 6:
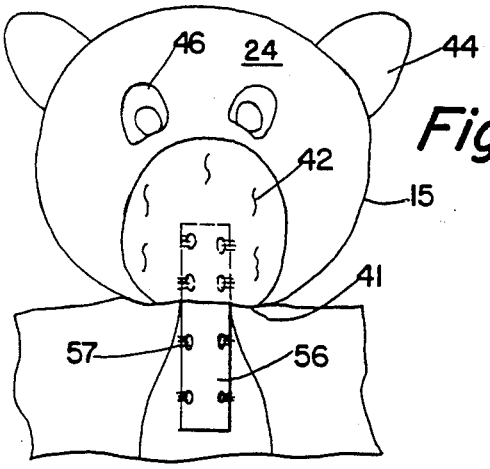
FIG. 6 is a partially broken away fragmentary view of the head and body illustrating the pivot member of the figurine of FIG. 1.

Referring now additionally to FIG. 6, the head 15 is constructed of the outer covering of fabric 24. Head 15 may be produced by taking multiple pieces of fabric cut to the approximate shape of the head 15, and then stitching the pieces together along the perimeter thereof to form the outer covering of the head 15. However, it will be appreciated that head 15 may be assembled in any one of a variety of ways and from any number of pieces of fabric including a single piece of fabric.

The fabric 24 of the head 15 is attached to or stitched to the fabric of the trunk 16 of the body 14 at 41. The head 15 is provided with fill or stuffing material 42 such as polyurethane foam which imparts a spherical three dimensional shape to the head 15. Additionally, as illustrated, the outside surface of the head 15 is preferably outfitted with a plurality of fanciful character features which impart a specific type of appearance to the head 15. Such features include ears 44, eyes 46, and a nose 50. Although one form of character has been illustrated in the drawings, it will be appreciated that head 15 may be outfitted in various manners to form a variety of character and animal-like images or appearances.

When the figurine 10 is attached to the book 12, the head 15 of the figurine 10 is capable of assuming a veriety of positions. Specifically, as shown in FIG. 1, when the book 12 is fully open the head 15 of the figurine 10 assumes a lowered position wherein the major vertical axis of the head 15, and the major axis of the pivot member 56 extend at an angle substantially perpendicular to the vertically extending spine 54 of the book 12. The major axis of pivot member 56 extends parallel to the major vertical axis of the head 15. Alternatively, when the book 12 is closed the head 15 of the figurine 10 assumes an upright or raised position wherein the major vertical axis of the head 15 extends substantially parallel to the spine 54 of the book 12. Similarly, the head 15 is capable of assuming a multitude of positions between the illustrated raised and lowered positiosn merely by placing the book 12 in respective partially closed or partially open positions. Thus, by moving the book 12 between the open and closed positions the head 15 correspondingly moves and is thus animated.

Referring now additionally to FIGS. 4–7 there is illustrated the means which facilitate the raising and lowering of the head 15. Specifically, there is provided a rigid pivot member 56 secured at one end within the head 15. The pivot member 56 may be made of any one of a variety of materials such as wood, plastic or metal. In a preferred embodiment pivot member 56 is rectangular shape and is about four inches long, one-half inch wide, and about one-eighth inch thick. In comparison, the overall height of figurine 10 is about 17 inches with an arm span of about 14 inches. It will be appreciated, however, that the present invention contemplates a figurine produced to any dimension and that the dimensions of various elements of the figurine may have to be modified to accommodate books of various sizes.

Each end of the pivot member 56 includes a plurality of holes 57 therein to facilitate the stitching of each end of the pivot member to its respective body part. More particularly, one end of the pivot member 56 is stitched to the stuffing 42 of the head 15. The other end of the pivot member 56 is stitched to the outer section of fabric designated generally at 60 which constitutes the outer layer of fabric which forms the trunk 16 of the body 14. Thus, the pivot member is located between the outer section of fabric 60 and the inner section designated generally at 61 which constitutes the inner layer of fabric which forms the trunk 16 of the body 14.

Figure 4:
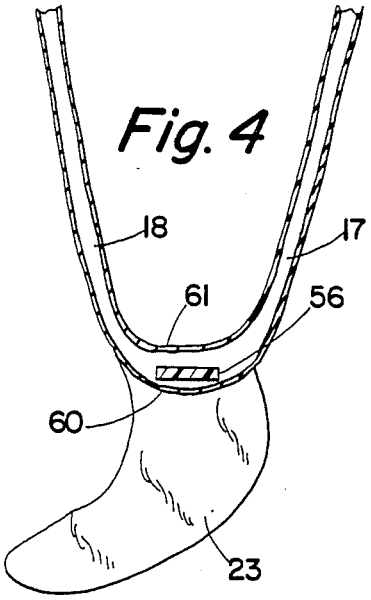
FIG. 4 is a cross-sectional view of the toy figurine of FIG. 2 in the position illustrated in such figure taken generally along line 4-4 thereof.
Figure 5:
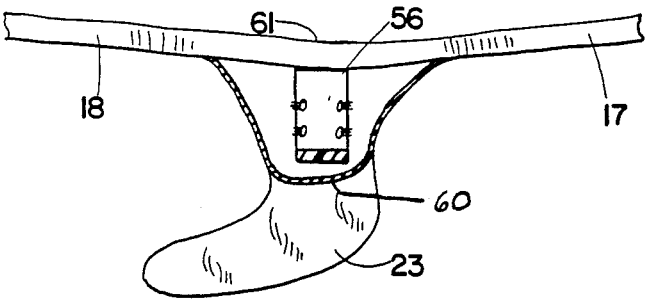
FIG. 5 is a cross-sectional view of the toy figurine of FIG. 1 in the position illustrated in such figure taken generally along line 5—5 thereof.

The figurine 10 further includes as shown in FIGS. 1 and 2 two lengths of elastic 62 and 63 which extend along the inside of the arms 17 and 18 of the figurine 10. More particularly, the elastic 62 and 63 is connected by stitching along the inside and top of the arms 17 and 18. The lengths of elastic 62 and 63 extend from about the proximity of the pivot member 56 to about the distal end of the arms 17 and 18. When the arms 17 and 18 are brought together as shown in FIG. 4, or the book 12 is closed as shown in FIG. 2, the lengths of elastic 62 and 63 are tensioned or biased and they impart a force to the sections of fabric 60 and 61 which form the trunk 16 and the pivot member 56. This force pulls the sections of fabric 60 and 61 tightly against the spine 54 of the book 12 and causes the pivot member 56 to fulcrum against the spine 54 and extend substantially parallel to the spine 54 which in turn raises the head 15 over the top of the book 12. Alternatively, when the arms 17 and 18 are separated as shown in FIG. 5, or the book 12 is opened as shown in FIG. 1, the length of the elastic 62 and 63 decreases and the tension is reduced or eliminated. The pivot member 56, because of its own weight and the weight of the head 15, is then pulled by gravity to a lowered position wherein the pivot member 56 extends substantially perpendicular to the spine 54 of the book 12.

The lengths of elastic 62 and 63 are of such a length and elasticity that when the book 12 is closed the elastic pulls the pivot member 56 tightly against the spine 54 and the head 15 is raised above the book 12. Alternatively, when the book 12 is opened the head 15 is lowered due to gravitation forces beneath the top of the book 12 and the pivot member 56 extends substantially perpendicular to the spine 54. Preferably, however, the lengths of elastic 62 and 63 are not too long. If the lengths of elastic are too long, when the book 12 is opened, the pivot member 56 will extend below a position perpendicular to the spine 54 such that when the lengths of elastic exert a force upon the sections of fabric 60 and 61 which form the trunk 16 and the pivot member 56, the pivot member 56 and head 15 may be pulled downwardly instead of upwardly. Preferably, in addition to the lengths of elastic 62 and 63, there are provided additional lengths of elastic 64 and 65 in the legs 20 and 22 of the figurine 10 which further secure the figurine 10 to the book 12. Lengths of elastic 62, 63, 64 and 65 may be constructed of any one of a variety of elastic materials capable of elastic or non-plastic deformation including the material from which a conventional rubber band is produced.

Figure 7:
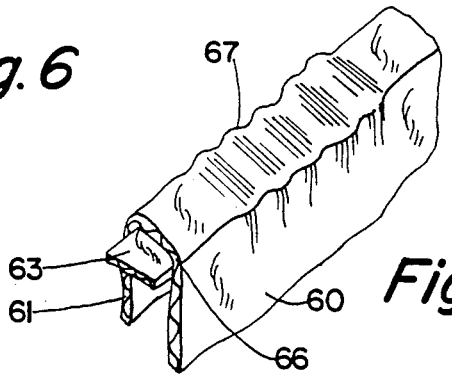
FIG. 7 is a fragmentary view of the elastic banding of the toy figurine of FIG. 1 taken generally at line 7-7 thereof.

Referring now to FIG. 7, there is illustrated a portion of the elastic 63 in the unstretched position or the position it would assume with the book 12 open. More particularly, elastic 63 is attached to the sections of fabric 60 and 61 which form the trunk 16 with stitching 66. Stitching 66 allows the elastic 63 to gather as shown generally at 67, or alternatively stretch out and become tensioned when the book 12 is closed.

It will be appreciated that an animated figurine made in accordance with the present invention may be used in combination with other items in addition to the illustrated book 12. For example, figurine 10 may be used in combination with the outer planar surface formed by the knee of a user. In such an application the pivot member 56 fulcrums against the outer surface of the knee. When the arms 17 and 18 are pulled or brought together by the user the lengths of elastic 62 and 63 are stretched or tensioned and they pull the fabric of the trunk 16 and the pivot member against the knee and the head 15 assumes a raised position. Similarly, when the force on the arms 17 and 18 is released, the pivot member 56 assumes a position substantially perpendicular to the outer surface of the knee and the head 15 is lowered. Thus, it will be appreciated that in addition to using the figurine 10 in combination with a book 12, or a user's knee, figurine 1 may be used with anything that provides a vertically extending planar surface to fulcrum the pivot member 56 against and permits the user access to the arms 17 and 18 so as to allow the user to pull and release the arms 17 and 18. Such items include for example the end rail of a staircase rail or the side of the back of a chair. When a figurine made in accordance with the present invention is intended for use with these alternative items, it will be appreciated that such a figurine may not necessarily include appendages such as a tail or legs which are not then necessary to effect the animation of the figurine.

In summary, the present invention provides an animated toy figurine for use by user in conjunction with a vertically extending surface, the figurine comprising a body having a trunk and at least a pair of appendages a head including a rigid pivot member connected to the head and attached to the trunk of the body, and a length of elastic, the elastic being attached along the length of one of the appendages, the elastic having appropriate length and elasticity to support a biasing force which pivots the pivot member against such vertically extending surface and causes the major axis of the pivot member to lie substantially in a vertically plane as the appendages are brought closer to one another about the vertically extending surface by the user, and releases the biasing force which pivots the pivot member away from the surface and causes thet major axis of the pivot member to lie in a substantially horizontal plane as the appendages are moved apart with respect to one another by the user.

Although the invention has been shown and described with respect to a certain preferred embodiment, it is obvious that equivalent alterations and modifications will occur to others skilled in the art upon the reading and understanding of the specification. The present invention includes all such equivalent alterations and modifications, and is limited only by the scope of the following claims.

What is claimed:

1. A book jacket for attachment to a book having a pair of covers and a spine interconnecting such covers which allows such cover to assume a multitude of partially and fully open and closed positions, said jacket comprising a fanciful figurine having a head and body including a trunk and at least a pair of appendages, said appendages including attachment means to facilitate the attachment of said appendages to such covers of such book, a rigid pivot member connected at one end to said head and connected at the other end to said trunk, and a length of elastic, said elastic being attached along the length of one of said appendages, said elastic having appropriate length and elasticity to produce a biasing force which pivots said pivot member against such spine of such book and raises said head with respect to such book as such covers are moved together towards a closed position and reduces said biasing force allowing gravitational forces to act on said head and permit said pivot member to pivot away from such spine of such book and thus lower said head with respect to such book as such covers are moved apart towards an open position.

2. A book jacket as set forth in claim 1 wherein said appendages form the arms of said figurine.

3. A book jacket as set forth in claim 1 wherein said elastic is attached on the inside of one of said appendages.

4. A book jacket as set forth in claim 3 further including a second length of elastic attached to another of said appendages such that said pivot member is disposed between said first length of elastic and said second length of elastic.

5. A book jacket as set forth in claim 4 wherein said body and said head include an outer covering of fabric formed from multiple pieces of fabric sewn together along portions of their outer perimeters.

6. A book jacket as set forth in claim 5 wherein said trunk comprises an inner section of fabric and an outer section of fabric and said pivot member is disposed between said inner and outer sections of fabric.

7. A book jacket as set forth in claim 6 wherein said inner section of fabric of said trunk is located between said pivot member and such spine of such book.

8. A book jacket as set forth in claim 7 wherein said pivot member comprises a rectangular-shaped rod.

9. A book jacket as set forth in claim 8 wherein said appendages further include a pair of legs.

10. A book jacket as set forth in claim 9 wherein said attachment means comprises pockets formed at the distal ends of said legs and said arms which are adapted to receive the corners of such book.

11. A book jacket as set forth in claim 10 wherein said lengths of elastic extend respectively from about the proximity of the pivot member to about the distal end of said arms.

12. A book jacket as set forth in claim 11 wherein said head includes a fill material which is stuffed within and contained within said outer covering of said head.

13. An animated toy figurine for use by a user in conjunction with a vertically extending surface, said figurine comprising a body having a trunk and at least a pair of appendages, a head including a rigid pivot member connected to said head and attached to said trunk of said body, and a length of elastic, said elastic being attached along the length of one of said appendages, said elastic having appropriate length and elasticity to produce a biasing force which pivots said piovt member against such vertically extending surface and causes the major axis of said pivot member to lie substantially in a vertical plane as said appendages are brought closer to one another about such vertically extending surface by such user, and releases said biasing force which pivots said pivot member away from such surface and causes the major axis of said pivot member to lie in substantially a horizontal plane as said appendages are moved apart with respect to one another by such user.

14. An animated toy figurine comprising a body consisting essentially of at least one piece of fabric which form a trunk and a pair of appendages connected to said trunk, a head connected to said trunk, a pivot member connected at one end to said head and connected at the other end to said fabric which forms said trunk, and a length of elastic, said elastic being attached along the length of one of said appendages, said elastic serving to produce a biasing force, whereby the pivoting member, when used with a supporting surface, pivots against such supporting surface when the elastic is tensioned, thereby animating said head.

15. An animated toy figurine as set forth in claim 13 wherein said truck comprises an inner piece of fabric and an outer piece of fabric, and said pivot member is disposed between said inner and said outer pieces of fabric.

16. An animated toy figurine as set forth in claim 15 wherein said pivot member comprises a rectangular-shaped rod.

17. An animated toy figurine as set forth in claim 14 wherein said trunk comprises an inner section of fabric and an outer section of fabric, and said pivot member is disposed between said inner and said outer sections of fabric.

18. An animated toy figurine as set forth in claim 17 wherein said pivot member comprises a rectangular-shaped rod.

* * * * *

UNITED STATES PATENT AND TRADEMARK OFFICE

CERTIFICATE OF CORRECTION

PATENT NO. : 4,832,648

DATED : May 23, 1989

INVENTOR(S) : Robert J. Theobald, Judith Thayer

It is certified that error appears in the above-identified patent and that said Letters Patent is hereby corrected as shown below:

On the title page

Please correct the second inventor's name to read --Judith Thayer--.

Column 3, line 9, delete "17" and insert --27--.

Column 6, line 64, delete "piovt" and insert --pivot--.

Column 7, line 14, delete "pivoting" and insert --pivot--.

Column 8, line 2, delete "truck" and insert --trunk--.

Signed and Sealed this

Thirteenth Day of February, 1990

*Attest:*

JEFFREY M. SAMUELS

*Attesting Officer*

*Acting Commissioner of Patents and Trademarks*